US010537783B2

(12) United States Patent
Medina-Brodsky et al.

(10) Patent No.: US 10,537,783 B2
(45) Date of Patent: Jan. 21, 2020

(54) SYSTEM AND METHOD FOR AUTOMATICALLY CONTROLLING A TRACK TIMING SYSTEM

(71) Applicant: Everlast Climbing Industries, Inc., Mendota Heights, MN (US)

(72) Inventors: Michael Medina-Brodsky, Longmont, CO (US); Christian Stockinger, Loveland, CO (US); Anne Jordan, Ft. Collins, CO (US); Pete Schiel, Denver, CO (US)

(73) Assignee: EVERLAST CLIMBING INDUSTRIES, INC., Mendota Heights, MN (US)

( * ) Notice: Subject to any disclaimer, the term of this patent is extended or adjusted under 35 U.S.C. 154(b) by 145 days.

(21) Appl. No.: 15/534,367

(22) PCT Filed: Dec. 7, 2015

(86) PCT No.: PCT/US2015/064301
§ 371 (c)(1),
(2) Date: Jun. 8, 2017

(87) PCT Pub. No.: WO2016/094314
PCT Pub. Date: Jun. 16, 2016

(65) Prior Publication Data

US 2017/0361198 A1 Dec. 21, 2017

Related U.S. Application Data

(60) Provisional application No. 62/090,000, filed on Dec. 10, 2014.

(51) Int. Cl.

| | |
|---|---|
| ***A63B 71/06*** | (2006.01) |
| ***A63K 3/00*** | (2006.01) |
| ***A63B 24/00*** | (2006.01) |

(52) U.S. Cl.
CPC ..... *A63B 71/0686* (2013.01); *A63B 24/0062* (2013.01); *A63B 24/0084* (2013.01);
(Continued)

(58) Field of Classification Search
CPC ..... G07C 1/22; G07C 1/24; A63B 71/0686; A63B 71/0662; A63B 24/0062; A63B 24/0084; A63B 69/00; A63B 2220/62
See application file for complete search history.

(56) References Cited

U.S. PATENT DOCUMENTS 4,074,117 A * 2/1978 DeLorean ..... G04C 23/50 340/323 R
5,511,045 A * 4/1996 Sasaki ..... G04F 8/08 340/323 R (Continued)

FOREIGN PATENT DOCUMENTS

WO 2007130645 A2 11/2007

OTHER PUBLICATIONS

PCT International Preliminary Report for International Application No. PCT/US2015/064301, filed Dec. 7, 2015, dated Jun. 22, 2017, 1 page.

(Continued)

*Primary Examiner* — Jasson H Yoo
(74) *Attorney, Agent, or Firm* — McAndrews, Held & Malloy, Ltd.

(57) ABSTRACT

System and method to automatically control a track timing system for humans and/or animals. One or several users are detected in start and finish areas on one or several tracks and automatically signaled to start by the system. Results such as finish time, start reaction time, false starts, split times, relay exchanges, and such can be calculated. The results can be displayed and distributed, and the system can be configured by a user.

32 Claims, 5 Drawing Sheets

(52) U.S. Cl.
CPC ..... *A63B 71/0622* (2013.01); *A63K 3/00* (2013.01); *A63B 2220/62* (2013.01)

(56) References Cited

U.S. PATENT DOCUMENTS

| | | | | |
|---|---|---|---|---|
| 6,072,751 | A | 6/2000 | Kirson et al. | |
| 2005/0135193 | A1* | 6/2005 | Kaski | A63B 71/0605 368/10 |
| 2014/0052279 | A1* | 2/2014 | Van Rens | A63B 24/0021 700/91 |
| 2014/0221159 | A1* | 8/2014 | Lawrence | A63K 3/023 482/8 |
| 2015/0116497 | A1* | 4/2015 | Doval | G01S 7/412 348/157 |

OTHER PUBLICATIONS

PCT International Search Report for International Application No. PCT/US2015/064301, filed Dec. 7, 2015, dated Feb. 26, 2016, 4 pages.

* cited by examiner

SYSTEM AND METHOD FOR AUTOMATICALLY CONTROLLING A TRACK TIMING SYSTEM

CROSS-REFERENCE TO RELATED APPLICATIONS/INCORPORATION BY REFERENCE

The present application claims priority under 35 U.S.C. § 119(e) to provisional application Ser. No. 62/090,000 filed on Dec. 10, 2014, entitled "System and Method for Automatically Controlling a Track Timing System." The above referenced provisional application is hereby incorporated herein by reference in its entirety.

FIELD OF THE INVENTION

The present invention is in the field of controlling a track timing system.

BACKGROUND OF THE INVENTION

Humans and animals have long played, recreated, worked out, trained, competed, and the like by moving through a defined distance. The defined distance may be along a defined path in a three-dimensional space with a defined start and a defined finish. For example, the defined distance may be within a track, course, or any suitable defined path. The movement may include running, walking, climbing, crawling, sliding, swimming, exercising, mastering obstacles, walking on hands, remotely controlling and/or riding vehicles including wheel chairs, cycles and so on. The movement may be performed by an individual human, an individual animal, or groups of humans or animals. For example, participants may be in a group spanning a distance together, such as in a wheelbarrow race.

A track or course includes a start area, defined confines, a defined path in three-dimensional space, and a finish area. The track can be defined along any path, such as horizontal, upwards, downwards, vertical, along obstacles, in water, air, on snow or ice, along ropes etc. and any combination thereof. The track can combine different media to move along or in, such as a rope leading into water, then going up a climbing wall, among other things. The confines can vary along the path of the track, i.e. it can be wider at some point and narrower at another point. The confines can be three-dimensional, such as a tube, a tunnel, a cavity, a path defined under water or a climbing course, stairs, down a snow or ice covered slope, and the like. As long as a user crosses from the start area into the track, stays within the confines of the track, and crosses from the track to the finish area, the track provides a defined, repeatable length of the moving distance in space and thus can be used to time a user and compare results for several users.

Several tracks next to each other with the same features can be used to determine the winners in competition, to compare the individually measured times of each user in each track, and so on.

Recognizing the wide variety of uses for tracks, the following description uses the example of a track in a flat, horizontal plane used by at least one human running a race. The race has a start, a finish, and a defined path. The disclosed embodiments are representative of preferred forms of the invention, but are intended to be illustrative rather than definitive of the invention, particularly regarding the form of the track and regarding the definition of the use, such as racing, walking, crawling, sliding, or such.

A variety of existing devices, such as stopwatches, clocks, counters, electronic timing systems, and the like, are currently used to measure the time elapsed from the start to finish of a race. The devices typically provide start information signaling the start of the race and measuring the time that elapses from that start information until the runner has crossed the finish line.

The person providing the timing, here called the timer person, can be either a runner themselves or an additional person who operates the timing system. The timer person may provide the start information, for example, by calling out "On your mark, Get set, Go". The pre-start signal, for example "On your mark, set" is the time interval where runners are in the start area front of the start line, ready to run, but are not allowed to move. The start signal, for example "go", signals that the runners may move from the start area into the track and should race down the track. There can be additional optical, audible or other signaling at the start signal such as a flash, a shot, beeps, vibration, etc. At the start signal the time measurement is started. The runner runs down the track and when he or she crosses the finish line into the finish area the clock is stopped and the elapsed time is presented as race time.

An example of an embodiment of such a system is a track to run on and a clock with a display, a start function, a finish or stop function, and the ability to measure and display the time elapsed between the start and the finish.

The start function can be provided for example by a button, for example next to the start line. The timer person provides the start signaling to the at least one runner and pushes the button which starts the clock. While racing, the clock measures the elapsed time since the start. When the first runner crosses the finish line the clock is stopped by the timer person, for example, with the same button that was used for start, or a different button. The elapsed time is displayed. The cycle may be repeated for additional races.

Systems like the one described above need an operator, either a separate person or at least one runner. For unsupervised users who wish to play, recreate, train, race, etc. this is undesirable because it prevents them from doing so or adds additional distractions and hurdles for their desired activity.

In the example of a playground or swimming pool where a track system is installed for the use of unsupervised children and adults of all ages and abilities, a system that is easy to use is desirable. In particular, a system that automatically conducts timing is desirable.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

The current invention therefore uses an automated device to control a start and record a finish of a race through at least one track, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Figure 1A:
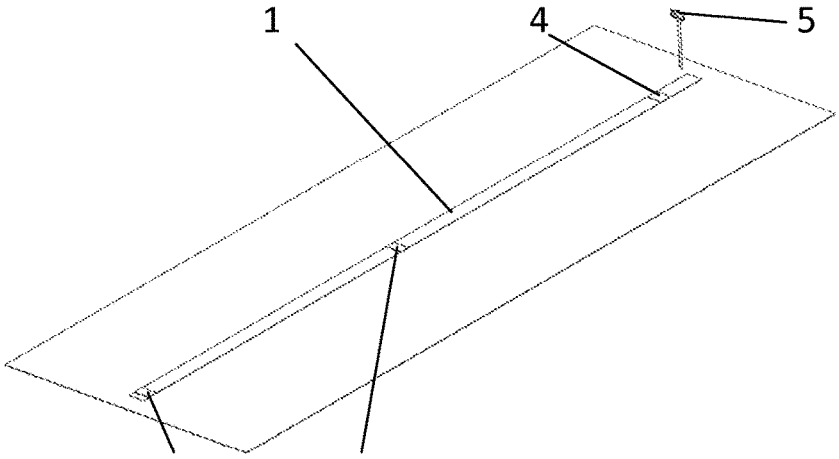
FIG. 1A shows a track with two start areas, a finish area and a clock in perspective.

The foregoing summary, as well as the following detailed description of certain embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings. It should also be understood that the embodiments may be combined, or that other embodiments may be utilized and that structural, logical and electrical changes may be made without departing from the scope of the various embodiments of the present invention. The following detailed description is, therefore, not to be taken in a limiting sense, and the scope of the present invention is defined by the appended claims and their equivalents.

As used herein, an element or step recited in the singular and proceeded with the word "a" or "an" should be understood as not excluding plural of said elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Furthermore, the term processor or processing unit, as used herein, refers to any type of processing unit that can carry out the required calculations needed for the invention, such as single or multi-core: CPU, Graphics Board, DSP, FPGA, ASIC or a combination thereof.

In a representative embodiment, at least one track has a detection device configured to detect at least one user being present or being not present in at least one start area in front of a start line relative to the track and in at least one finish area behind a finish line relative to the track. For example, the detection device can be a pressure sensitive device on or underneath the track material that generates signals when at least one user steps on them and when the at least one user leaves. Other detection devices may include, for example, an optical detection device, a force detection device, radio frequency identification (RFID) tags, and/or any suitable detection device.

When a runner steps on or off such an area, signals are generated. Signals from a start area can be used to provide start signaling, and a signal from a finish area can be used to generate finish signaling. These signals are provided to at least one clock. A clock has at least a processing unit, a display unit and a time measuring unit. Optionally, the clock can have at least one signaling unit. The one or more signaling units can be part of the clock and/or separate devices connected with the clock, for example installed close to a starting area. A clock at least processes the signals from the at least one start area and at least one finish area of at least one track, signals to the at least one runner, measures at least the race time, and displays the measured time.

The following describes an exemplary embodiment of the invention for one runner on one track. The processing clock is capable of being in several states.

Initially, the clock is in a waiting state, waiting for signals from one of the start areas to come in, while signaling that the system is active (for example, by providing dashes on the display).

When the runner steps onto a start area, signals are generated and provided to the clock. The clock switches into the start state and provides the pre-start signal to the runner, for example, "on your mark" and "set". The "on your mark" pre-start signal may be in the form of showing a blinking 0:00 on the display and a red dot for a period of time, or any suitable display or presentation. The "set" pre-start signal can be in the form of showing a steady 0:00 and a yellow dot for a period of time, among other things.

Then, the clock switches into the race state. For example, the clock may present a start or "go" signal with a green dot on the signaling unit, among other things, and the running time counting up in seconds and tenths of a second. The runner starts running and races down the track while the clock presents the start signal and the running time.

In an embodiment, a split time can be transmitted and/or displayed where a runner has started from a starting area farther away from the finish area and comes across a starting area closer to the finish area by, for example, using the resulting signals from the closer starting area to measure a corresponding split time and display the split time for a period of time.

Additionally or alternatively, various embodiments provide areas for registering split times in tracks that provide signals when a runner enters them. In a track that is not straight, these areas can be used in addition to split times to verify that the user has not left the confines of the track.

Intermediate starting areas can be designed to function as both start areas and finish areas to, for example, provide shorter tracks and a flexible usage of the track.

Intermediate starting areas can be designed as two areas next to each other. These could for example be flat plates next to each other on a running track, two holds next to each other on a climbing wall etc. This allows for relays, where one runner finishes at one such area while the subsequent runner starts on the other area. The signals from both areas can be compared to ascertain a fair relay exchange, for which the starting runner may only start after the finishing runner has arrived. Those signals can also be used to calculate and display the exchange time. In the case of regular races, not relay races, the signals of both areas can be used together, for example, for split times as described above.

In various embodiments, when the runner crosses a finish line and steps on the finish area, the clock receives those signals. The clock may switch into the finish state, stop the running time, which is now the resulting race time of the race that elapsed since the "go" signal, and turns the green dot off, if the signaling unit is present. The resulting race time is displayed for a period of time to inform the runner. Subsequently, the clock may go back to the waiting state and the cycle can repeat.

In certain embodiments, the clock may time out and return to a waiting state if, for example, the runner never reaches a finish area.

In an exemplary embodiment, each of the described states can be divided into more states. For example, the pre-start state may include sub-states, such as "on your mark" and "set".

As an option, the following functions can be implemented in a representative embodiment.

During the race state, the runner may be required to leave the start area after the "go" signal for a correct start. Therefore, the clock monitors the signals from the start area after the "go" signal for the duration of a false start time window. A correct start occurs when a signal that the runner has stepped off the start area is received within the false start time window. If a "step off" signal is detected prior to the false start time window during the start state, the runner has left pre-maturely and the start is not valid, which is called a false start. In various embodiments, the clock may display a message, such as "FA.L", for a period of time and then switch back into the wait state.

If the runner leaves too late, the clock may return to a wait state. For example, if a step off signal is not received by the clock during a late start time window after the "go" signal, the start is not correct.

The time measured from the start to the latest "step off" signal from the start area can be interpreted as the so called start reaction time. It signifies how fast the runner reacted to the start signal and started running. A start reaction time window can be used to determine when the latest "step off" signal from the start area was received. That start reaction time can be displayed by the clock, for example, after the start reaction time window, for a period of time. After the display of the start reaction time, the clock can switch back to the running time until the finish.

As an option, the clock can have multiple sets of states, which allows for more than one runner to be started and timed. For example, when a second runner steps on a start area while the first runner is still racing, the clock uses a second set of wait, start, race, and finish states to provide the start information for that second runner to start and time the second race.

In various embodiments, multiple runners can be signaled with the clock using multiple sets of states. Each finishing runner may have the racing time displayed when they step on a finish area. After displaying the resulting race time for a period of time to inform the runner that finished most recently, the running time switches to the time of the subsequent runner on the track that will finish next, and so forth. Naturally, the longer the track and the slower the runners, the more runners can be accommodated to race at the same time, and for example ensure that subsequent runners don't pass each other.

The following describes various embodiments providing several tracks next to each other.

Each track has at least one start area and at least one finish area with for example signal mats. Start areas and finish areas of the tracks are preferably next to each other. In any case, the tracks provide the same running distances to runners. Each track has its own clock with at least the components as described above in the example for one track. In addition the clocks are connected to each other to share processing information and are at least able to synchronize.

When a first runner activates a start area, the corresponding first clock switches from wait state to start state and signals the pre-start signals. If within the pre-start signaling time another runner activates a start area on another track, the corresponding other clock switches from wait state to start state and signals its pre-start signals, but the period of time of presenting is synchronized with the first clock in respect to presenting the "go" signal and starting the race. For any other runner activating a start area within the start state of the first clock, the corresponding clock switches state and shows synchronized pre-start signals. Subsequently, the activated clocks on their respective tracks simultaneously present in a synchronized manner the "go" signal to all detected runners, switch into race state, and the race begins. The runners race down the track, split times as described above may be detected, and when they touch their respective finish areas the corresponding clocks shows the resulting race times.

Similar to the example above for one runner, more than one group of runners can run at the same time on the track and be timed because the clocks can have multiple sets of states.

The following is an example with a time out for a subsequent presentation of the start signals after a preceding start. After the first group left, for a period of time out or wait state all start area signals may be ignored. During that time up to the end of the start state for the second group members of the second group may step on the start areas. For all the activated start areas the corresponding and synchronized "go" signal are presented, the clocks switch into the subsequent race state, and thus the runners of the second group start synchronized. When a runner from the first group in front of the second group finishes, the time gets presented for a period of time and then switches to the running time of the upcoming runner of the second group.

This can work similarly for a third group as well as for more groups.

The same functions for false starts, start reaction times, relay starts and late starts as described above for runners on one track can be implemented for runners on more than one track.

The system can distribute the results of at least one runner into at least one computer network for any suitable purpose. For example, the results can be sent to a smartphone of a runner or a third party, to an account in an internet application, be shared with friends, coaches, and so on.

The results may additionally and/or alternatively be presented at a display, such as a statistics board, a virtual scoreboard on the web, or any suitable display.

Data can also be transmitted from at least one user into the system, for example, from that user's smartphone, and for example be used to configure the system according to the personal wishes of that user. For example, a training scheme or a bench mark time can be configured into the system to race against.

All above functions of the invention can be utilized by humans or animals that are not necessarily running, for example by walking, playing, recreating, swimming, crawling, climbing, sliding, remotely controlling and/or driving a vehicle, rolling with a wheel chair or moving with other assistant devices, and so forth.

Users can also use only parts of the described functionality of the invention, for example only the start reaction time function to train in starts only, the relay function to train in relay exchanges only, or any combination thereof.

When a track is not defined by a straight line additional detection devices may be added to further define confines of a track and ensure the user stays within the confines. For example, in a winding obstacle course the user must create additional signals at checkpoints in a particular sequence to prove he or she has actually covered the distances within the confines of the track. The user may be required, for example, to reach at least one place with an additional signal source and activate the at least one additional signal source, such as buttons, pressure sensitive mats, photo sensors, RFID tags, or any suitable detection device to ensure no distance shortcuts have been used, i.e. the user stayed within the confines of the track. The clock registers those signals and evaluates whether the user has stayed within the confines of the track. In various embodiments, the clock may be configured to provide signaling identifying correct or incorrect usage.

Figure 1B:
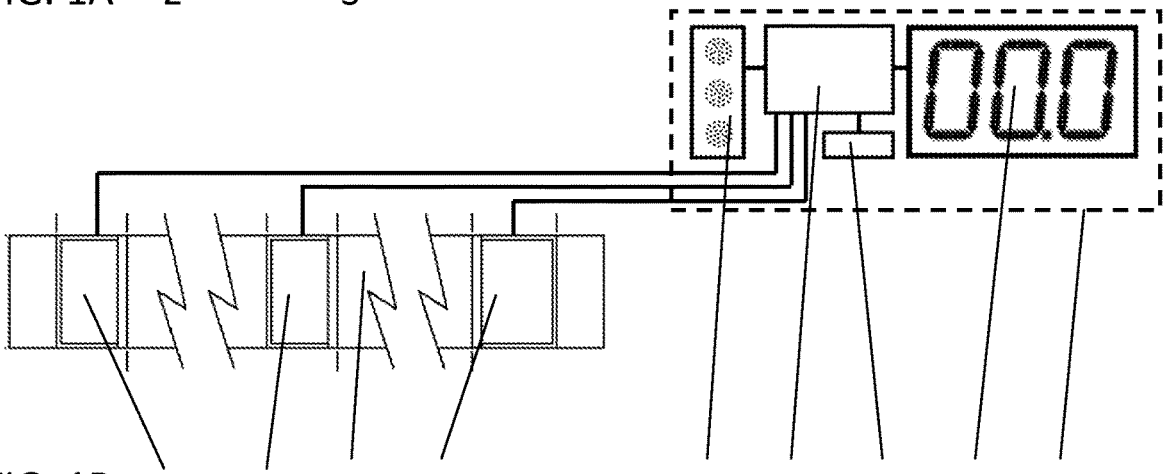
FIG. 1B shows details of the track and clock of FIG. 1A.

FIG. 1A shows a preferred embodiment of a track 1 including a first start area 2 and a second start area 3, a finish area 4 and a clock 5. The start areas 2 and 3 and the finish area 4 can create signals whether users are present in the areas or not and transmit those signals to the clock 5. As shown in FIG. 1B the signals are sent to the clock 5 which includes a processing unit 7, a power supply and data connection system 8, a display 9 and a signaling unit 6. The processing unit 7 receives the signals and processes them as described below, globally ascribed to the clock in the following text.

Figure 6:
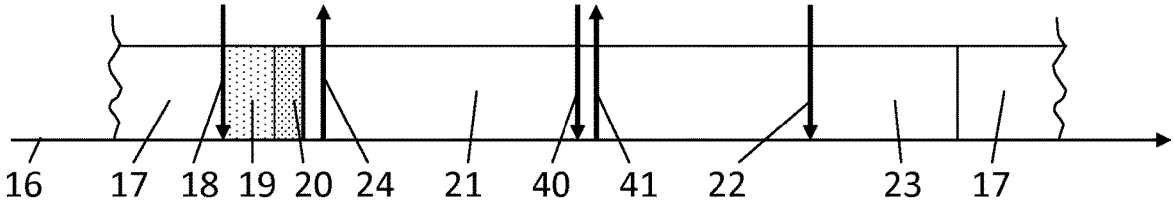
FIG. 6 shows a timeline with the signals of the start and finish areas and states.

FIG. 6 shows the timeline 16 and various time periods described below.

Figure 2:
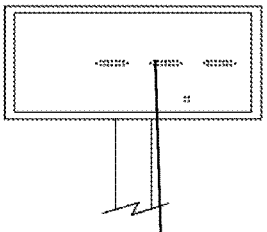
FIG. 2 shows a clock displaying a wait state.

To begin with the clock 5 is in wait state 17. It is assumed that the at least one user knows that the system is active and ready for their interaction with the system. To that end the clock 5 can present for example dashes 10 as shown in FIG. 2.

When a user moves into a start area the detection device in the start area can detect that and generate a corresponding signal. When a user moves out of a start area the detection device can detect that as well and generate a corresponding signal. It is possible that a detection device generates several of such signals, for example when the user jumps up and down. In such a case the clock may evaluate several consecutive signals. One preferred embodiment of such an evaluation is utilizing time windows as described below.

Figure 3A:
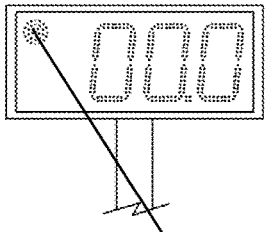
FIG. 3A shows a clock in start state, presenting a "On your mark" command.
Figure 3B:
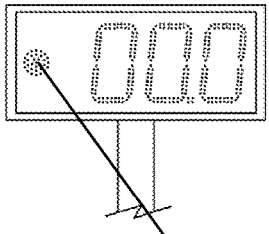
FIG. 3B shows a clock in start state, presenting a "Set" command.

When the clock 5 receives a "user entered the starting area" signal 18 from for example the first start area 2 that a user is present, it changes into the start state. The signaling device 6 shows for a period of time 19, for example 4 seconds, a red circle 11 and the display shows a blinking 00.0, indicating the "On your mark" information to the user, as shown in FIG. 3A. Then the signaling device 6 shows a yellow circle 12 and the display shows 00.0 without blinking for a period of time 20 as shown in FIG. 3B. Together time periods 19 and 20 define the length of the start state.

Figure 4:
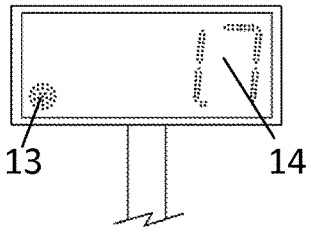
FIG. 4 shows a clock in race state, presenting a "go" command and running time.

Then the clock 5 changes into the race state, which includes a time period 21. During that time the signaling device presents a green circle 13 and a running time 14, here in seconds and tenths of a second at the race time 1.7 seconds, as shown in FIG. 4.

The clock expects a "user departed from the starting area" signal 24 during the race time. If that signal 24 does not occur during a time window that is an indication that the user has not left the start area in time to participate in the race. In that case the clock can switch back into wait state.

When the signal 24 is detected, the user is running down the track.

When the user has started from the first starting area 2 he or she will cross the second starting area 3. At that time an "entered into start area" signal 40 is generated as well as a little later a "departed from start area" signal 41. The clock 5 can calculate a split time with these signals and display it for a period of time.

Figure 9:
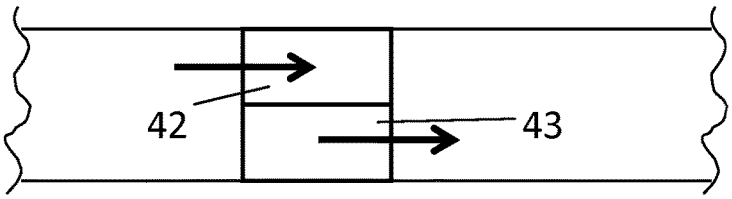
FIG. 9 shows a start area that is divided into an upper area and a lower area.

For a relay race at least one area that is divided as shown in FIG. 9 can be used. An "entered into finished area" signal is generated when the previous runner enters the upper area 42 symbolized by the incoming arrow. A "departed from start area" signal 41 is generated when the subsequent runner leaves the lower area 43, symbolized by the outgoing arrow. The signals generated from the upper and lower area can be used to determine if a fair start occurred (the second runner started after the first runner had arrived), the relay delay time (the time between the arrival of the first runner and the start of the second runner) and so on. Multiple relay segments can be accomplished with multiple of such areas at each point of relay exchange along the track.

Figure 5:
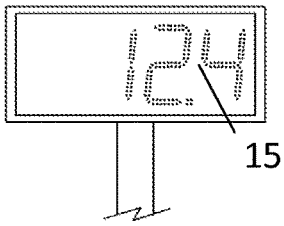
FIG. 5 shows a clock in finish state, presenting an example finish time.

When the user crosses the finish line and is detected by the finish area 4 that creates a finish signal 22, the clock 5 changes into the finish state for a period of time 23, during which it presents the measured race time 15 on the display, for example 12.4 seconds as in FIG. 5.

After the finish state 23 the clock switches back into wait state 17 and awaits the next signals from the start areas.

If the runner is detected running but never detected in the finish area the clock uses a time out period to stop running and goes back into the wait state 17.

Figure 7:
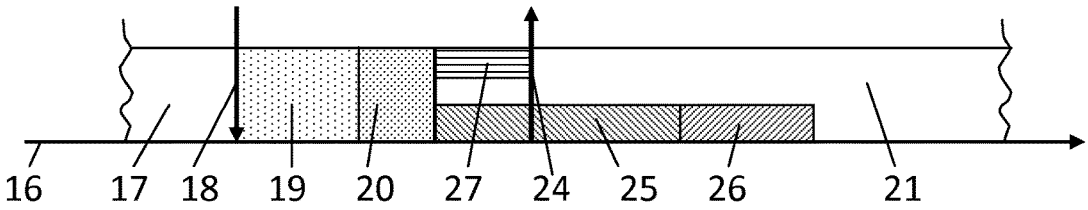
FIG. 7 shows a timeline of the start state and subsequent start reaction time window.

To detect start reaction times the clock uses a start reaction window 25 shown in FIG. 7. After switching from wait state 17 through a "user entered start area" signal 18, presenting signaling periods 19 and 20 as described above, the clock switches into race state 21. If during the start reaction window 25 a "user departed from the starting area" signal 24 occurs, the elapsed time 27 since the start is interpreted as the start reaction time. That time value can be displayed for example during time window 26 to inform the user. If there is a sequence of "user entered start area" signals 18 and departing signals 24, created for example because the user hops up and down, the clock uses the window 25 to look for the latest signal 24 to measure the start reaction time. If such signals are detected for even longer than the start reaction window 25 that can be interpreted as indication that the user is not running and the clock 5 returns to the wait state as above.

If a departing signal 24 is detected during the time windows 19 and 20 but not during the race state 21 that is an indication that the user left early. This can be called a false start and the clock can indicate that for example by displaying FA.L for a period of time after which it goes back to wait state 17.

Figure 8:
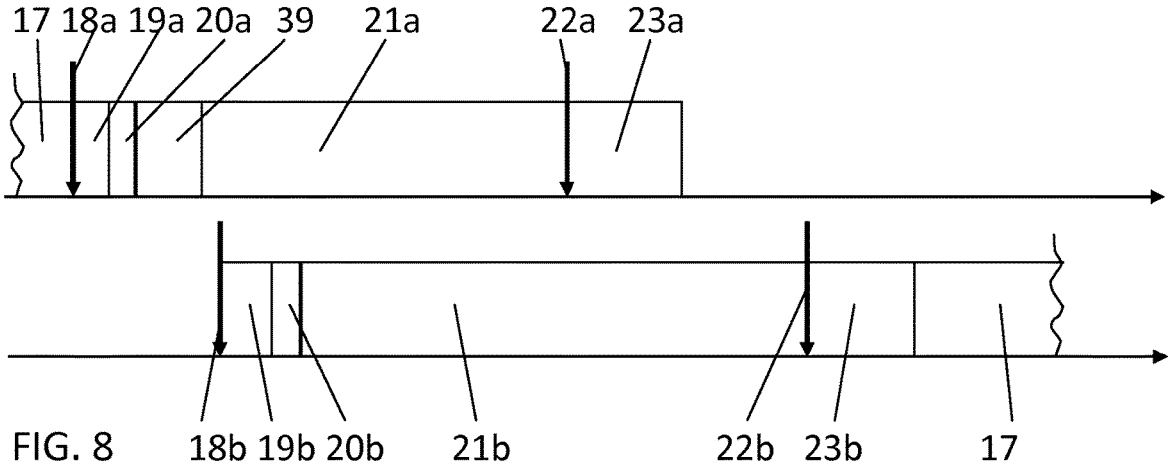
FIG. 8 shows two subsequent starts and finishes with two set of states.

FIG. 8 shows a time line with states when a second user runs subsequently before a first user has finished. When the first user is detected by signal 18*a* the clock 5 switches from wait state 17 (which is the same for all race states because the system is either in use or not in use) to the first start state having time periods 19*a* and 20*a*. Then the clock switches into the first race state 21*a*. An option is to introduce a time out period 39 during which no new inputs are accepted from subsequent runners. That ensures that the first runner has time to run a sufficient distance to not interfere with the second runner.

After that time out period 39 the clock detects an entering signal 18*b* from a second user, activates a second start state having time periods 19*b* and 20*b* and then switches into the second run state 21*b*. In the mean time when the first user is detected in a finish area with a signal 22*a*, the first user's race time is displayed during the first finish state 23*a*. After that first finish state 23*a* the clock 5 switches to the second race state 21*b* and waits for the second user to come in. A second finish signal 22*b* is detected; the second race time is calculated and displayed during the second finish state 23*b*. Should no new start be detected, the clock 5 switches back to wait state 17.

There can be multiple of such sets of states for multiple users.

Figure 10:
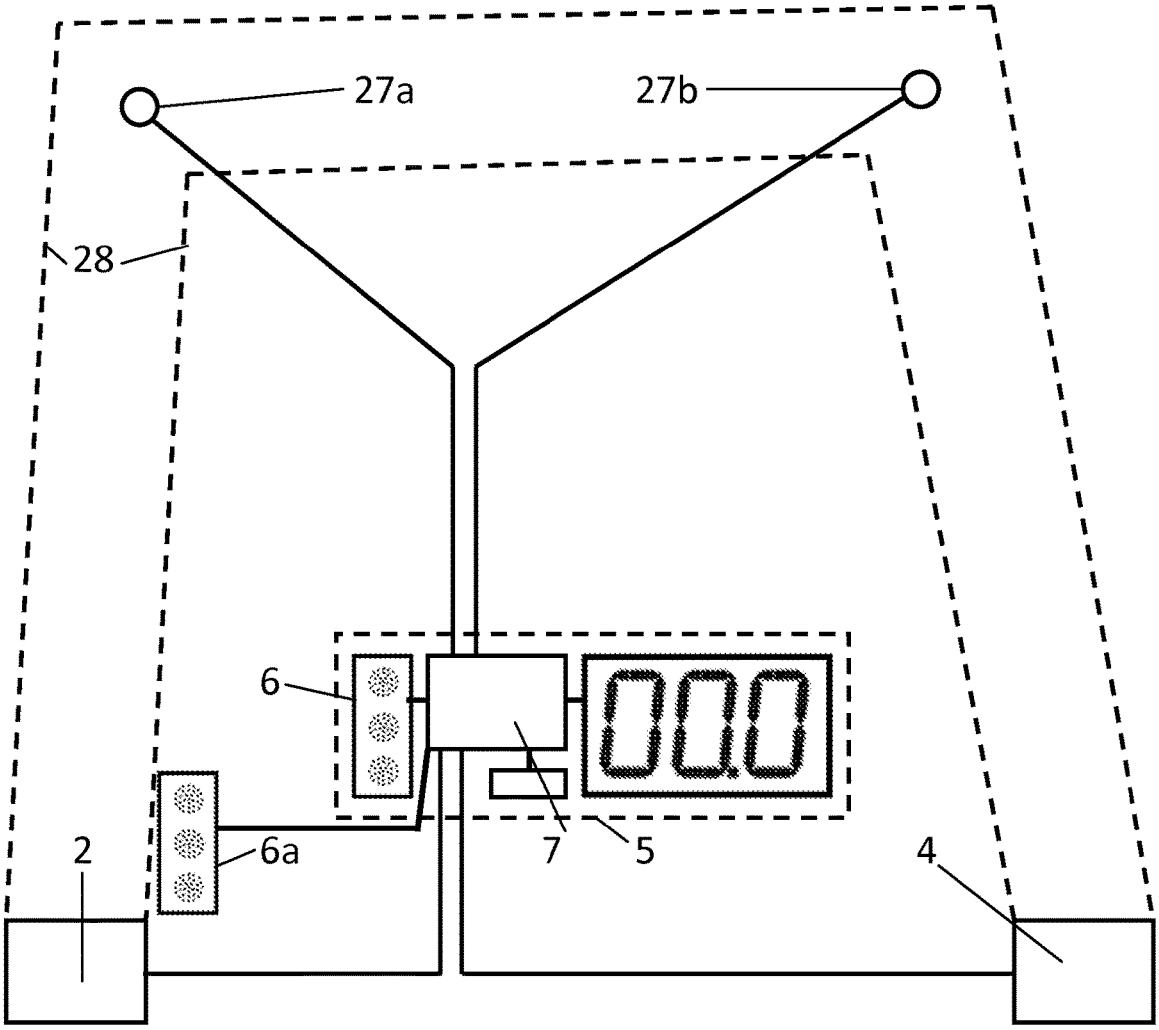
FIG. 10 shows a bent track with additional checkpoint signals for the user to prove that he or she has stayed within the confines of the track.

FIG. 10 shows an example of a track that is not straight. It has curved confines 28, one start area 2 and one finish area 4. The clock 5 has a signaling unit 6 and in addition is connected to a second signaling unit 6*a* that is installed close to the start area 2. Both signaling units 6 and 6*a* are controlled by the processing unit 7 of the clock 5. The clock has two checkpoints with additional inputs that receive signals from button 27*a* and button 27*b*. A user that starts from the start area 2 generates a signal first on button 27*a*, then on 27*b* and finally reaches the finish area 4. In various embodiments, this sequence allows the clock to evaluate the signals as a successfully performed track and to show a finish time. In other cases, the clock may communicate that the track has not been completed successfully. One or more of the above described additional functions can be utilized here. In addition the checkpoint signals 27*a* and 27*b* can be used to calculate split times that the clock 5 can display or further process.

Figure 11A:
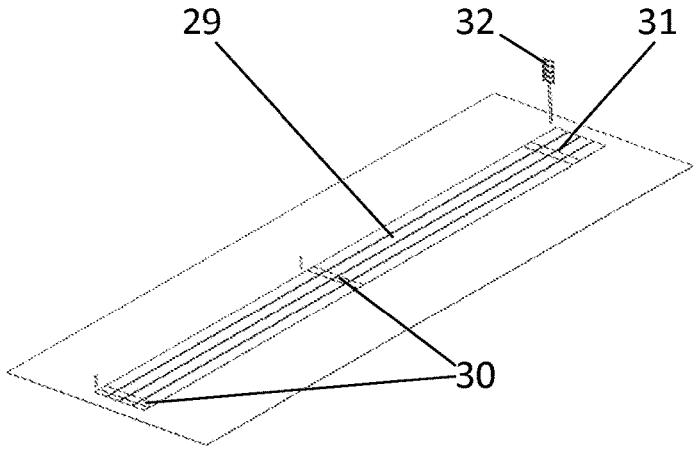
FIG. 11A shows a fourfold track with start and finish areas and a fourfold clock in perspective.
Figure 11B:
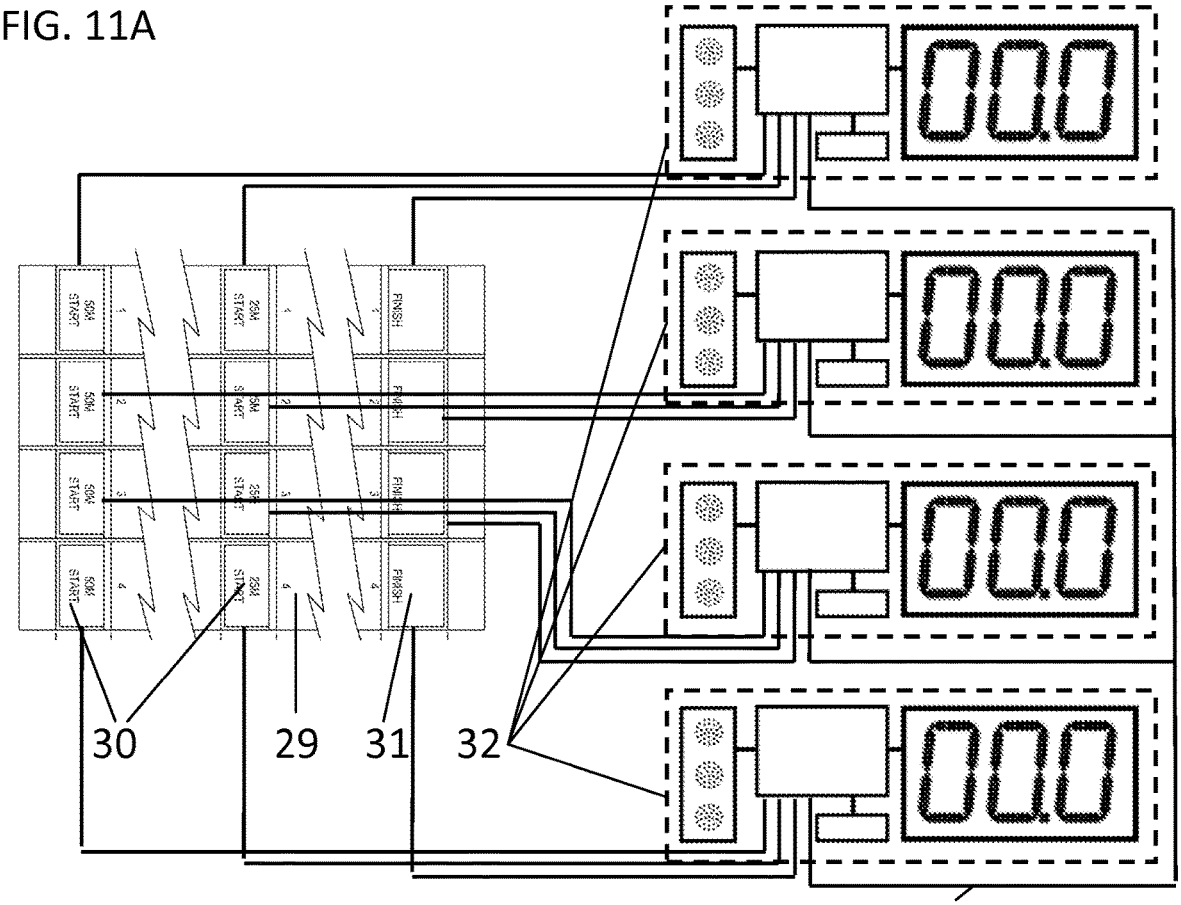
FIG. 11B shows details of the track and clocks of FIG. 11A.

FIG. 11A shows a fourfold track 29 with two fourfold start areas 30 and one fourfold finish area 31 and a fourfold clock 32. The fourfold clock 32 includes four units of the single clock 5 in FIG. 1A or FIG. 1B. FIG. 11B shows a different view of the track 29, the start and finish areas and the fourfold clock 32. Each start area of a particular track corresponds to a part of the fourfold clock 32 as indicated in the drawing. The fourfold clock 32 has at least an additional data channel 33 between the single clock units which can be used for at least synchronization.

Figure 12:
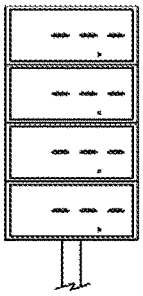
FIG. 12 shows the fourfold clock displaying a wait state.
Figure 13A:
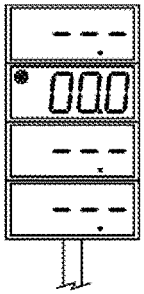
FIGS. 13*a, b, c* and *d* show the displays when 4 users subsequently get detected.
Figure 13B:
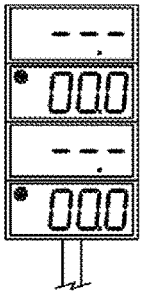
Figure 13C:
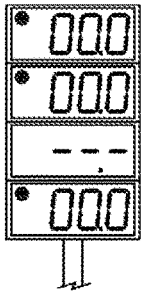
Figure 13D:
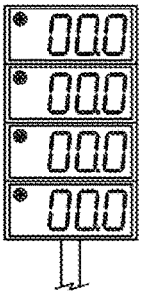
Figure 14:
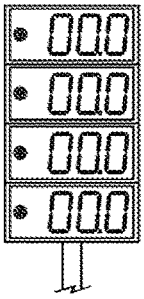
FIG. 14 shows a synchronized "Set" signal
Figure 15:
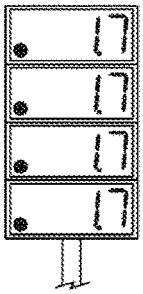
FIG. 15 shows a synchronized running state.
Figure 16:
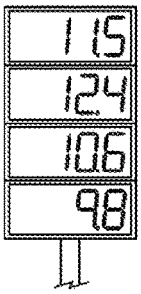
FIG. 16 shows an example result of a fourfold race.
Figure 17:
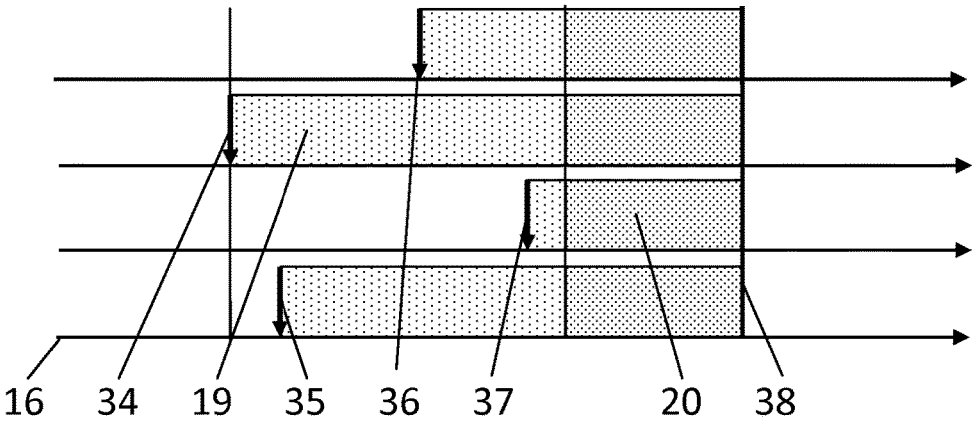
FIG. 17 shows the timeline of the start signals of 4 subsequently detected users.

FIG. 12 shows the system with the fourfold clock 32 in wait state 17, showing dashes. FIG. 13*a* shows the fourfold clock 32 when the first user signal 34 of FIG. 17 was detected from the corresponding start area. This starts the "on your mark" signal 19, which corresponds to a display of the signaling and display unit of the corresponding clock as shown in FIG. 13*a*. When the next user signal 35 in FIG. 17 comes in, the corresponding clock shows signal 19 as also shown in FIG. 13*b*. When the next user signal 36 in FIG. 17 comes in, the corresponding clock shows signal 19 as also shown in FIG. 13*c*. When the last user signal 37 in FIG. 17 comes in, the corresponding clock shows signal 19 as also shown in FIG. 13*d*. In this example then all four clocks synchronize through the data channel 33 from FIG. 11B and show in a synchronized manner the "set" signal 20 as also shown in FIG. 14. Then they switch synchronously at the point in time 38 into the race state 21 as shown in FIG. 15. Assuming that the runners all run and get detected in the corresponding finish areas, the fourfold clock 32 displays result racing times for example as shown in FIG. 16.

The above example assumed that all users were detected within the signal time window 19. An alternate is to extend the detection to include the "set" time window 20. But if a user is not detected within those time periods, the corresponding clock will not switch from wait state 17 and will not participate in the synchronized start and timing of the race.

For multiple tracks the same functions of false start, start reaction time, late start, one or more split times, start of more than one runner on one track, relay exchanges as described for one track apply. If more than one runner on one track moves into a start area within the start state that starts the group of runners in a synchronized manner.

The data generated by the system can be transmitted through the power supply and data connection system 8. The data connection system connects the processing unit 7 with computer networks such as local networks or the internet. The processing unit 7 can connect with the networks and exchange data with other devices such as user smartphones, user computers or servers. Various applications can be utilized to further process, store and distribute the generated data.

Aspects of the present invention provide a track timing system. The track timing system may comprise one or more detection devices 2, 3, 4 configured to detect at least one user of the track timing system. The one or more detection devices 2, 3, 4 may be configured to generate a first detection signal based on a first detection and a second detection signal based on a second detection. The one or more detection devices 2, 3, 4 are positionable at one or more of at least one start area 2, 3 of a track 1 and at least one finish area 4 of the track 1. The track timing system may comprise one or more processing units 7. The one or more processing units 7 may be configured to receive the first detection signal 18. The one or more processing units 7 may be configured to enter a start state 19, 20 in response to the first detection signal. The one or more processing units 7 may be configured to transition to a race state 21 after a predetermined period of time in the start state 19, 20. The one or more processing units 7 may be configured to receive the second detection signal 22. The one or more processing units 7 may be configured to transition from the race state 21 to a finish state 23 in response to the second detection signal 22. The one or more processing units 7 may be configured to determine an elapsed time during the race state 21. The track timing system may comprise one or more display units 9 configured to display the elapsed time determined by the one or more processing units 7.

In various embodiments, the one or more processing units 7 are configured to generate a start signal 13 for presentation as the one or more processing units 7 transitions to the race state 21. In certain embodiments, the start signal 13 is presented on the one or more display units 9. In an exemplary embodiment, the track timing system comprises one or more signaling units 6. The start signal 13 is presented at the one or more signaling units 6.

In certain embodiments, the first detection signal 18 corresponds with the one or more detection devices 2, 3, 4 detecting a presence of the at least one user. The one or more detection devices 2, 3, 4 is configured to generate a third detection signal 24 after the first detection signal 18 and before the second detection signal 22. The third detection 24 signal corresponds with the one or more detection devices 2, 3, 4 detecting a lack of presence of the at least one user. The one or more processing units 7 terminates the race state 21 if the third detection signal 24 is not received within a predetermined period of time after transitioning to the race state 21. In an exemplary embodiment, the one or more processing units 7 is configured to calculate a start reaction time 27 based on an elapsed time between the transition to the race state 21 and receiving the third detection signal 24. In various embodiments, the one or more processing units 7 is configured to generate a false start signal for presentation if the one or more processing units 7 receives the third detection 24 signal prior to transitioning to the race state 21.

In various embodiments, the one or more detection devices 2, 3, 4 is configured to detect a plurality of users of the track timing system. The first detection signal 18 and the second detection signal 22 are each a plurality of signals 18*a*, 18*b*, 22*a*, 22*b*, 34-37 and each of the plurality of signals corresponds to one of the plurality of users. The elapsed time comprises a plurality of elapsed times and each of the plurality of elapsed times is determined for each user of the plurality of users. The one or more display units 9 is configured to display each of the plurality of elapsed times. In certain embodiments, the one or more processing units 7 is configured to synchronize 38 the transition to the race state 21 after the predetermined period of time in the start state 19, 20 for each of the plurality of users.

In an exemplary embodiment, the one or more detection devices 2, 3, 4 is configured to generate a third detection signal 40 after the first detection signal 18 and before the second detection signal 22. The third detection signal 40 may correspond with the one or more detection devices 2, 3, 4 detecting the presence of the at least one user. In various embodiments, the one or more processing units 7 is configured to determine a split time corresponding to an elapsed time between the transition to a race state 21 and receiving the third detection signal 40. The one or more display units 9 is configured to display the split time determined by the one or more processing units 7. In an exemplary embodiment, the one or more processing units 7 is configured to validate that the at least one user has stayed within the confines of the track 1 based at least in part on the third detection signal 40.

In certain embodiments, the one or more detection devices 2, 3, 4 comprises a plurality of detection devices positionable 2, 3 at the at least one start area 2, 3 of the track to detect a plurality of users. In various embodiments, the track timing system comprises a plurality of the track timing system. The one or more processing units 7 of each of the plurality of the track timing system is configured to synchronize 38 the transition to the race state 21. In an exemplary embodiment, the track timing system comprises a communication component 8 configured to transmit at least the elapsed time to one or more external devices and/or receive system configuration information from the one or more external devices. The system configuration information may comprise a training scheme and/or a bench mark time to race against.

In an exemplary embodiment, the one or more detection devices 2, 3, 4, 42, 43 is configured to generate a third detection signal and a fourth detection signal after the first detection signal 18 and before the second detection signal 22. The third detection signal may correspond with a first 42 one of the one or more detection devices 2, 3, 4, 42, 43 positionable in a relay exchange finish area 42. The first 42 one of the one or more detection devices 2, 3, 4, 42, 43 may detect the presence of the at least one user. The fourth detection signal may correspond with a second 43 one of the one or more detection devices 2, 3, 4, 42, 43 positionable in a relay exchange start area 43. The second 43 one of the one or more detection devices 2, 3, 4, 42, 43 may detect a lack of presence of the at least one user. The one or more processing units 7 is configured to determine, based on the third detection signal and the fourth detection signal, whether a fair start in a relay exchange has occurred and/or a relay delay time corresponding with an elapsed time between the third detection signal and the fourth detection signal.

Various embodiments provide a method for controlling a track timing system. The method may comprise detecting, by one or more detection devices 2, 3, 4, at least one user of the track timing system. The one or more detection devices 2, 3, 4 may be positionable at one or more of at least one start area 2, 3 of a track 1 and at least one finish area 4 of the track 1. The method may comprise generating, by the one or more detection devices 2, 3, 4, a first detection signal 18 based on a first detection and a second detection signal 22 based on a second detection. The method may comprise receiving, by one or more processing units 7, the first detection signal 18. The method may comprise entering a start state 19, 20, by the one or more processing units 7, in response to the first detection signal 18. The method may comprise transitioning, by the one or more processing units 7, to a race state 21 after a predetermined period of time in the start state 19, 20. The method may comprise receiving, by the one or more processing units 7, the second detection signal 22. The method may comprise transitioning, by the one or more processing units 7, from the race state 21 to a finish state 23 in response to the second detection signal 22. The method may comprise determining, by the one or more processing units 7, an elapsed time during the race state 21. The method may comprise displaying, by one or more display units 9, the elapsed time determined by the one or more processing units 7.

In an exemplary embodiment, the method may comprise generating, by the one or more processing units 7, a start signal 13 for presentation as the one or more processing units 7 transitions to the race state 21. In various embodiments, the start signal 13 is presented on the one or more display units 9 and/or one or more signaling units 6.

In certain embodiments, the method may comprise generating, by the one or more detection devices 2, 3, 4, a third detection signal 24 after the first detection signal 18 and before the second detection signal 22. The first detection signal 18 may correspond with the one or more detection devices 2, 3, 4 detecting a presence of the at least one user. The third detection signal 24 may correspond with the one or more detection devices 2, 3, 4 detecting a lack of presence of the at least one user. The method may comprise terminating the race state 21, by the one or more processing units 7, if the third detection signal 24 is not received within a predetermined period of time after transitioning to the race state 21. In various embodiments, the method may comprise calculating, by the one or more processing units 7, a start reaction time 27 based on an elapsed time between the transition to the race state 21 and receiving the third detection signal 24. In an exemplary embodiment, the method may comprise generating, by the one or more processing units 7, a false start signal for presentation if the one or more processing units 7 receives the third detection signal 24 prior to transitioning to the race state 21.

In various embodiments, the method may comprise detecting, by the one or more detection devices 2, 3, 4, a plurality of users of the track timing system. The method may comprise displaying, by the one or more display units 9, a plurality of elapsed times. The first detection signal 18 and the second detection signal 22 are each a plurality of signals 18*a*, 18*b*, 22*a*, 22*b*, 34-37 and each of the plurality of signals corresponds to one of the plurality of users. The elapsed time comprises the plurality of elapsed times and each of the plurality of elapsed times being determined for each user of the plurality of users. In certain embodiments, the method comprises synchronizing 38, by the one or more processing units 7, the transition to the race state 21 after the predetermined period of time in the start state 19, 20 for each of the plurality of users.

In an exemplary embodiment, the method comprises generating, by the one or more detection devices 2, 3, 4, a third detection signal 40 after the first detection signal 18 and before the second detection signal 22. The third detection signal 40 may correspond with the one or more detection devices 2, 3, 4 detecting the presence of the at least one user. In certain embodiments, the method comprises determining, by the one or more processing units 7, a split time corresponding to an elapsed time between the transition to a race state 21 and receiving the third detection signal 40. The method may comprise displaying, by the one or more display units 9, the split time determined by the one or more processing units 7. In various embodiments, the method comprises validating, by the one or more processing units 7, that the at least one user has stayed within the confines of the track 1 based at least in part on the third detection signal 40.

In certain embodiments, the method comprises detecting, by the one or more detection devices 2, 3, 4, a plurality of users at the at least one start area 2, 3 of the track 1. In various embodiments, the method comprises synchronizing 38, by the one or more processing units 7 of each of a plurality of the track timing system, the transition to the race state 21 for the plurality of the track timing system. In an exemplary embodiment, the method comprises transmitting, by a communication component 8, at least the elapsed time to one or more external devices. In certain embodiments, the method comprises receiving, by a communication component 8 of the track timing system, system configuration information from one or more external devices. The system configuration information comprises a training scheme and/or a bench mark time to race against.

In various embodiments, the method comprises generating a third detection signal after the first detection signal 18 and before the second detection signal 22 by a first 42 one of the one or more detection devices 2, 3, 4, 42, 43 positionable in a relay exchange finish area 42 in response to the first 42 one of the one or more detection devices 2, 3, 4, 42, 43 detecting a presence of the at least one user. The method comprises generating a fourth detection signal after the third detection signal and before the second detection signal 22 by a second 43 one of the one or more detection devices 2, 3, 4, 42, 43 positionable in a relay exchange start area 43 in response to the second 43 one of the one or more detection devices 2, 3, 4, 42, 43 detecting a lack of presence of the at least one user. The method comprises determining, by the one or more processing units 7 and based on the third detection signal and the fourth detection signal, whether a fair start in a relay exchange has occurred and/or a relay delay time corresponding with an elapsed time between the third detection signal and the fourth detection signal.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a device is "operable" to perform a function whenever the device comprises the necessary hardware and code (if any is necessary) to perform the function, regardless of whether performance of the function is disabled, or not enabled, by some user-configurable setting.

Other embodiments of the invention may provide a computer readable device and/or a non-transitory computer readable medium, and/or a machine readable device and/or a non-transitory machine readable medium, having stored thereon, a machine code and/or a computer program having at least one code section executable by a machine and/or a computer, thereby causing the machine and/or computer to perform the steps as described herein for automatically controlling a track timing system.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. A track timing system comprising:

one or more detection devices positionable at one or more of at least one start area of a track and at least one finish area of the track, the one or more detection devices configured to automatically detect at least one user of the track timing system, the one or more detection devices configured to automatically generate a first detection signal based on a first detection of a presence of the at least one user entering the at least one start area and a second detection signal based on a second detection;

one or more processing units configured to:

receive the first detection signal corresponding with the presence of the at least one user automatically detected entering the at least one start area, enter a start state in response to the first detection signal, transition to a race state after a predetermined period of time in the start state, receive the second detection signal, transition from the race state to a finish state in response to the second detection signal, and determine an elapsed time during the race state; and one or more display units configured to display the elapsed time determined by the one or more processing units.

2. The system according to claim 1, wherein the one or more processing units are configured to generate a start signal for presentation as the one or more processing units transitions to the race state.

3. The system according to claim 2, wherein the start signal is presented on the one or more display units.

4. The system according to claim 2, comprising one or more signaling units, wherein the start signal is presented at the one or more signaling units.

5. The system according to claim 1, wherein:

the one or more detection devices is configured to generate a third detection signal after the first detection signal and before the second detection signal, the third detection signal corresponding with the one or more detection devices detecting a lack of presence of the at least one user at the at least one start area, and the one or more processing units terminates the race state if the third detection signal is not received within a predetermined period of time after transitioning to the race state.

6. The system according to claim 5, wherein the one or more processing units is configured to calculate a start reaction time based on an elapsed time between the transition to the race state and receiving the third detection signal.

7. The system according to claim 5, wherein the one or more processing units is configured to generate a false start signal for presentation if the one or more processing units receives the third detection signal prior to transitioning to the race state.

8. The system according to claim 1, wherein:

the one or more detection devices is configured to detect a plurality of users of the track timing system, the first detection signal and the second detection signal are each a plurality of signals, each of the plurality of signals corresponding to one of the plurality of users, the elapsed time comprises a plurality of elapsed times, each of the plurality of elapsed times being determined for each user of the plurality of users, and the one or more display units is configured to display each of the plurality of elapsed times.

9. The system according to claim 8, wherein the one or more processing units is configured to synchronize the transition to the race state after the predetermined period of time in the start state for each of the plurality of users.

10. The system according to claim 1, wherein the one or more detection devices is configured to generate a third detection signal after the first detection signal and before the second detection signal, the third detection signal corresponding with the one or more detection devices detecting the presence of the at least one user.

11. The system according to claim 10, wherein:

the one or more processing units is configured to determine a split time corresponding to an elapsed time between the transition to a race state and receiving the third detection signal, and the one or more display units is configured to display the split time determined by the one or more processing units.

12. The system according to claim 10, wherein the one or more processing units is configured to validate that the at least one user has stayed within the confines of the track based at least in part on the third detection signal.

13. The system according to claim 1, wherein the one or more detection devices comprises a plurality of detection devices positionable at the at least one start area of the track to detect a plurality of users.

14. The system according to claim 1, comprising a plurality of the track timing system, wherein the one or more processing units of each of the plurality of the track timing system is configured to synchronize the transition to the race state.

15. The system according to claim 1, comprising a communication component configured to at least one of:

transmit at least the elapsed time to one or more external devices, and receive system configuration information from the one or more external devices, the system configuration information comprising at least one of:

a training scheme, and a bench mark time to race against.

16. The system according to claim 1, wherein:

the one or more detection devices is configured to generate a third detection signal and a fourth detection signal after the first detection signal and before the second detection signal, the third detection signal corresponding with a first one of the one or more detection devices positionable in a relay exchange finish area, the first one of the one or more detection devices detecting the presence of the at least one user, the fourth detection signal corresponding with a second one of the one or more detection devices positionable in a relay exchange start area, the second one of the one or more detection devices detecting a lack of presence of the at least one user, and the one or more processing units is configured to determine, based on the third detection signal and the fourth detection signal, one or more of:

whether a fair start in a relay exchange has occurred, and a relay delay time corresponding with an elapsed time between the third detection signal and the fourth detection signal.

17. A method for controlling a track timing system, the method comprising:

automatically detecting, by one or more detection devices, at least one user of the track timing system, the one or more detection devices positionable at one or more of at least one start area of a track and at least one finish area of the track;

automatically generating, by the one or more detection devices, a first detection signal based on a first detection of a presence of the at least one user entering the at least one start area and a second detection signal based on a second detection;

receiving, by one or more processing units, the first detection signal corresponding with the presence of the at least one user automatically detected entering the at least one start area;

entering a start state, by the one or more processing units, in response to the first detection signal;

transitioning, by the one or more processing units, to a race state after a predetermined period of time in the start state;

receiving, by the one or more processing units, the second detection signal;

transitioning, by the one or more processing units, from the race state to a finish state in response to the second detection signal;

determining, by the one or more processing units, an elapsed time during the race state; and displaying, by one or more display units, the elapsed time determined by the one or more processing units.

18. The method according to claim 17, comprising generating, by the one or more processing units, a start signal for presentation as the one or more processing units transitions to the race state.

19. The method according to claim 18, wherein the start signal is presented on at least one of:

the one or more display units, and one or more signaling units.

20. The method according to claim 17, comprising:

generating, by the one or more detection devices, a third detection signal after the first detection signal and before the second detection signal, wherein the third detection signal corresponds with the one or more detection devices detecting a lack of presence of the at least one user, and terminating the race state, by the one or more processing units, if the third detection signal is not received within a predetermined period of time after transitioning to the race state.

21. The method according to claim 20, comprising calculating, by the one or more processing units, a start reaction time based on an elapsed time between the transition to the race state and receiving the third detection signal.

22. The method according to claim 20, comprising generating, by the one or more processing units, a false start signal for presentation if the one or more processing units receives the third detection signal prior to transitioning to the race state.

23. The method according to claim 17, comprising:

detecting, by the one or more detection devices, a plurality of users of the track timing system, and displaying, by the one or more display units, a plurality of elapsed times, wherein:

the first detection signal and the second detection signal are each a plurality of signals, each of the plurality of signals corresponding to one of the plurality of users, and the elapsed time comprises the plurality of elapsed times, each of the plurality of elapsed times being determined for each user of the plurality of users.

24. The method according to claim 23, comprising synchronizing, by the one or more processing units, the transition to the race state after the predetermined period of time in the start state for each of the plurality of users.

25. The method according to claim 17, comprising generating, by the one or more detection devices, a third detection signal after the first detection signal and before the second detection signal, the third detection signal corresponding with the one or more detection devices detecting the presence of the at least one user.

26. The method according to claim 25, comprising:

determining, by the one or more processing units, a split time corresponding to an elapsed time between the transition to a race state and receiving the third detection signal, and displaying, by the one or more display units, the split time determined by the one or more processing units.

27. The method according to claim 25, comprising validating, by the one or more processing units, that the at least one user has stayed within the confines of the track based at least in part on the third detection signal.

28. The method according to claim 17, comprising detecting, by the one or more detection devices, a plurality of users at the at least one start area of the track.

29. The method according to claim 17, comprising synchronizing, by the one or more processing units of each of a plurality of the track timing system, the transition to the race state for the plurality of the track timing system.

30. The method according to claim 17, comprising transmitting, by a communication component, at least the elapsed time to one or more external devices.

31. The method according to claim 17, comprising receiving, by a communication component of the track timing system, system configuration information from one or more external devices, the system configuration information comprising at least one of:

a training scheme, and a bench mark time to race against.

32. The method according to claim 17, comprising:

generating a third detection signal after the first detection signal and before the second detection signal by a first one of the one or more detection devices positionable in a relay exchange finish area in response to the first one of the one or more detection devices detecting a presence of the at least one user, generating a fourth detection signal after the third detection signal and before the second detection signal by a second one of the one or more detection devices positionable in a relay exchange start area in response to the second one of the one or more detection devices detecting a lack of presence of the at least one user, and determining, by the one or more processing units and based on the third detection signal and the fourth detection signal, one or more of:

whether a fair start in a relay exchange has occurred, and a relay delay time corresponding with an elapsed time between the third detection signal and the fourth detection signal.

* * * * *